United States Patent [19]

Broom

[11] Patent Number: 4,895,349

[45] Date of Patent: Jan. 23, 1990

[54] APPARATUS AND METHOD FOR BORING THROUGH THE TAPHOLE IN A MOLTEN METAL BLAST FURNACE

[75] Inventor: Gilbert R. Broom, Schererville, Ind.

[73] Assignee: G.R.B. Enterprises, Inc., Schererville, Ind.

[21] Appl. No.: 316,157

[22] Filed: Feb. 27, 1989

Related U.S. Application Data

[63] Continuation-in-part of Ser. No. 122,023, Nov. 18, 1987, abandoned.

[51] Int. Cl.[4] ..... C21B 7/12

[52] U.S. Cl. ..... 266/45; 266/271

[58] Field of Search ..... 266/45, 271; 408/57

[56] References Cited

U.S. PATENT DOCUMENTS

| | | | |
|---|---|---|---|
| 1,304,981 | 5/1919 | Hoagland | 408/57 |
| 2,912,887 | 11/1959 | Andreasson | 408/57 |
| 3,862,750 | 1/1975 | Broom | 266/271 |
| 4,436,285 | 3/1984 | Woodings | 266/271 |
| 4,669,707 | 6/1987 | Kenning | 266/45 |

*Primary Examiner*—S. Kastler

*Attorney, Agent, or Firm*—Woodard, Emhardt, Naughton, Moriarty & McNett

[57] ABSTRACT

A drill shaft assembly for a blast furnace taphole-opening system includes a drill shaft adapted for receipt of a drill bit at its forward end and for coupling with a hollow drill tool piece at its rearward end. The drill shaft has a solid cross-section along substantially its entire length and is provided, beginning at its rearward end, with an air channel which is in communication with a source of pressurized air for clearing dust from the taphole as it is being drilled. A coupling means is provided so that the drill shaft may be detachably attached to the drill tool piece shaft so that it is readily replaceable.

19 Claims, 2 Drawing Sheets

APPARATUS AND METHOD FOR BORING THROUGH THE TAPHOLE IN A MOLTEN METAL BLAST FURNACE

CROSS-REFERENCE TO RELATED APPLICATIONS

The present application is a continuation in part of my co-pending U.S. patent application Ser. No. 122,023 filed 11-18-87, now abandoned.

FIELD OF THE INVENTION

The present invention relates to the field of metallurgical furnace taphole-opening apparatus and more specifically to a drill shaft assembly and method for use with a molten metal blast furnace tap hole percussion drill and related molten metal blast furnace taphole-opening tools.

BACKGROUND OF THE INVENTION

Metallurgical furnaces, such as molten metal blast furnaces, are normally opened for tapping by drilling a hole through a clay refractory material disposed in the furnace taphole. Background on blast furnace operation may also be found in U.S. Pat. No. 4,475,720 entitled Cast House Emission Control System to which this inventor is a co-inventor.

Drilling the taphole is ordinarily performed by a percussion-type drill and drilling tools which normally include a long, hollow shaft of high alloy tool steel pipe with a rock bit secured to the end thereof. As the bit drills through the refractory material, a great deal of dust is deposited within the bore. As drilling is continued the dust often tends to bind the bit, impeding further drilling. Often the high build up of dust will make it difficult to extract the bit from the bore once the bit breaks through to the molten metal. This binding causes damage to the drill shaft since it cannot be easily removed. Sometimes the hole itself may plug up. On other occasions if the drill binds up due to dust buildup it can only be removed by the use of an oxygen lance to cut the shaft.

In order to continuously clear the dust the drill bit in prior art devices has been provided with multiple holes which communicate with the bore of the drill shaft. The bore in the drill shaft in prior art devices extends for the entire length of the shaft from its connection to the drill motor to its connection with the drill bit. Pressurized air is directed down the hollow drill shaft through the holes in the bit to provide a continuous stream of pressurized air exiting the front of the bit, then passing to the side and behind the bit out the newly bored hole and forcing with it the dust concentration.

Drilling is continued until the drill bit strikes a glowing "skull" which is formed by contact of the clay materials with the molten metal within the furnace. Continued drilling after reaching the skull will break through into the blast furnace at which point the molten metal surges back through the taphole and into a runner trough for eventual distribution into various pugh ladles. Often times the surge of molten metal melts the drill bit. It then overcomes the pressurized air in the larger drill shaft bore and surges up the bore until it reaches the drill motor resulting in the destruction or severe damage to the motor and drill shaft.

Another disadvantage of the prior art devices is the excessive cost involved with replacing the components which were melted by the molten metal backwash. In anY event, the lower portion of the drill shaft which extends during drilling into the molten metal (2800 degrees Fahrenheit) is damaged. The drill shaft of the prior art was commonly made from a long piece of high alloy tool steel pipe with typically a 3/16ths-inch bore through its entire length or by the welding together of two shorter such pipes. That length extended from the drill motor to the drill bit. For a typical one taphole blast furnace, the furnace is drilled anywhere from seven to twelve times per day seven days every week. Consequently, drilling a taphole is an expensive process since an entire new drill shaft has to be replaced after each drilling. Considering the frequency of drilling, any savings in materials due to improved design is significant.

One prior art effort at reducing the cost of drill shafts was to break the drill shaft pipe into two components. Consequently, if there was no backwash, only the lower portion, which extended into the molten metal needed to be replaced. These components were joined in the middle by a coupling. In the prior art the coupling was done by threading the ends of the two drill shaft pipes and then having a coupling with internal threads. However, the entire thread length of each pipe fit inside the coupling so that the coupling and pipe mating often froze and could not be disengaged. Consequently, most current designs use just a single pipe and avoid the expense of the coupling. In addition the above mentioned design still used an internal bore through the length of the drill shaft and consequently still suffered from the molten metal backwash problem and the expense of using pipe steel.

Another method for solving the backwash problem is as described in this inventor's previous U.S. Pat. No. 3,862,750. However, that method requires the drilling of a portion of the taphole with one drill shaft and then using a specialized chuck apparatus to replace the more expensive pipe shaft with a less expensive solid shaft in the middle of the drilling process. This procedure slows the drilling process, requires more than one shaft, and requires tool changing in the environment of a blast furnace.

The present invention recognized the need for a drill shaft assembly which is less expensive, which continues to remove or improves the removal of the dust produced by drilling through the clay refractory material and which inhibits molten metal backwash from destroying the drill motor and adjacent components.

SUMMARY OF THE INVENTION

Generally speaking there is provided an improved drill shaft assembly for a blast furnace taphole-opening apparatus which retards molten metal backwash, aids in the removal of dust produced from the taphole drilling operation and allows for the use of cheaper materials. In the preferred embodiment, a drill bit is connected to the forward end of a drill shaft and the forward end of the drill shaft is solid. The rearward end of a drill shaft is coupled to the forward end of a drill tool piece shaft which is secured at its rearward end to a drill motor. The drill tool piece shaft defines a central axial bore in communication with a high pressure air source. The forward end of the drill shaft is solid while the rearward end is provided with an air flow channel in communication with the central bore of the drill tool piece shaft. Air forced through the central bore and through the air flow channel provides a forced air path for the removal of dust from the taphole drilling operation.

In an alternative embodiment, the drill shaft defines a longitudinal groove extending the length thereof. An air blast tube is fixed within the groove to extend nearly the length of the drill shaft to direct the forced air to the forwardmost end of the drill shaft and to the drill bit.

It is an object of the present invention to provide an improved and less expensive drill shaft assembly for drilling tapholes in a molten metal blast furnace.

It is a further object of the present invention to provide an improved drill shaft assembly which provides for removal of dust while drilling, retards molten metal backwash following taphole drilling of a blast furnace and allows the use of less expensive materials.

Further objects and advantages of the present invention will become apparent from the following description of the preferred embodiment.

DESCRIPTION OF THE PREFERRED EMBODIMENT

Figure 1:
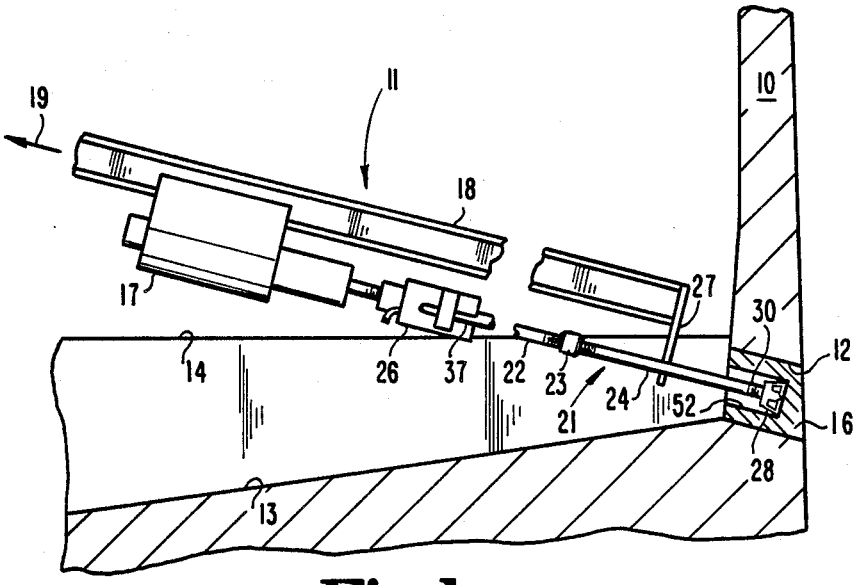
FIG. 1 is a schematic side elevational view of a taphole-opening apparatus including a drill shaft assembly in accordance with a preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the princiPles of the invention as illustrated therein being contemplated as would normally occur to one skilled in the art to which the invention relates.

Referring to FIG. 1 there is shown a taphole-opening apparatus 11 including a drill shaft assembly in accordance with a preferred embodiment of the present invention. A conventional blast furnace, partly shown and designated generally as 10, includes a taphole 12 through which molten metal may exit into a runner trough 13 disposed in the surrounding floor 14. During blast furnace operation, taphole 12 contains a plug 16 of refractory material. When withdrawal of molten metal from furnace 10 is desired a hole is drilled in plug 16 in the diameter desired for the cast.

Taphole opening apparatus 11 generally includes a percussion drill 17 which is slidably mounted on a rail 18. Rail 18 is pivotally mounted in the direction of arrow 19 to allow taphole-opening apparatus 11 to be swung in and out of position for drilling. As is known, a motor assembly (not shown) is provided to move percussion drill 17 along rail 18, toward and away from taphole 12. As is also known, a boom assembly (not shown) may be used to move the entire taphole opening apparatus 11.

In accordance with a preferred embodiment of the present invention, drill shaft apparatus 21 includes drill tool piece 22, coupling 23, and replaceable drill shaft 24. These components are secured to one another to form drill shaft apparatus 21 which acts as a unit and is mounted to percussion drill 17 by any appropriate means known in the art. One such manner of connecting drill shaft apparatus 21 is chuck 26, which is disclosed in U.S. Pat. No. 3,862,750 issued to Broom the disclosure of which is hereby expressly incorporated by reference. Drill shaft apparatus 21 is secured and driven at one end by chuck 26 and is supported intermediately by slotted guide member 27 which is secured at the end of rail 18. At the furthest end of drill shaft apparatus 21 is threadedly secured a rock bit 28 for drilling through plug 16.

Figure 2:
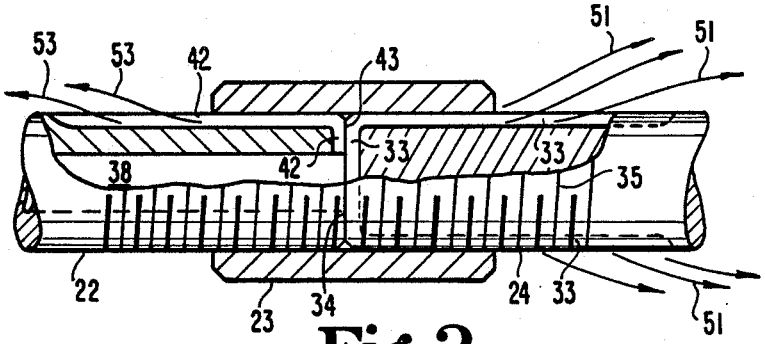
FIG. 2 is a side view, partially in section, of a portion of the drill shaft assembly of FIG. 1, with a portion thereof broken away showing a preferred embodiment of the present invention.
Figure 3:
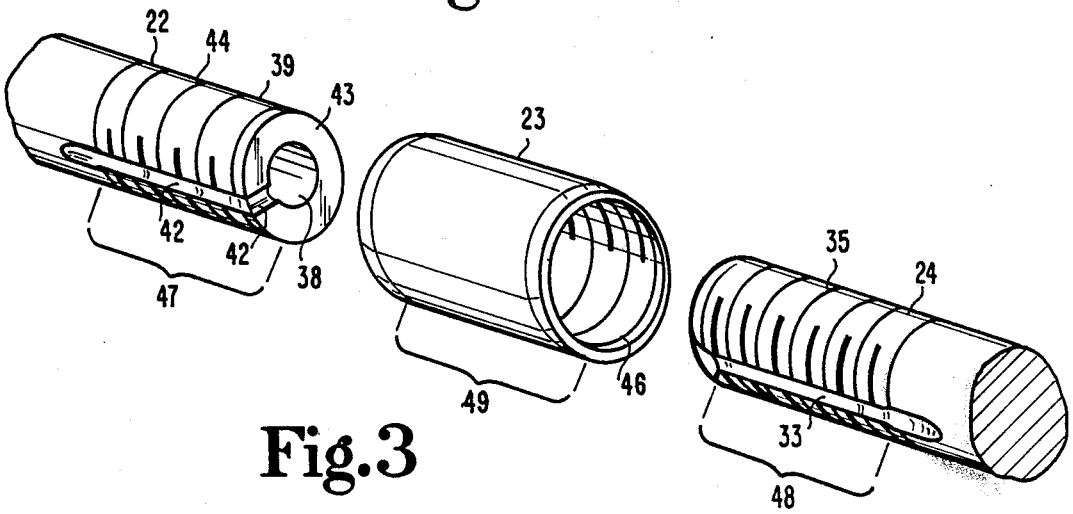
FIG. 3 is an exploded view of a portion of the drill shaft assembly of FIG. 2.
Figure 4:
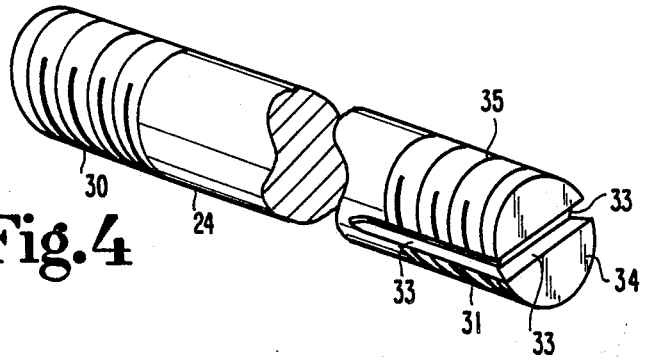
FIG. 4 is a fragmented perspective view of the drill shaft of FIG. 2.

To reduce the high cost of the prior art associated with the frequent destruction of expensive high alloy tool steel pipe drill shafts, the present invention is provided with intermediate directed air channel means for precluding binding of the drill bit due to the build up of dust and to preclude molten metal backwash. Referring to FIG. 2, the directed air channel means includes using a solid drill shaft 24 in place of the tool steel shaft with the central bore of the prior art. Drill shaft 24 in a preferred embodiment is made from a solid bar of 1018 cold rolled steel which is significantly less expensive than the steel pipe previously used. Since in the preferred embodiment, drill shaft 24 does not have a central bore and is solid, a lower grade and cheaper bar of steel can be used and still provide the same or greater shaft strength as higher grade and more expensive pipe. Of course, other suitable grades of solid bar may be used. The forward end 30 of drill shaft 24 is threaded for receipt of rock bit 28. (See FIGS. 1 and 4) The rearward end 31 of drill shaft 24 defines a continuous groove 33. Groove 33 extends diametrically across end face 34 of drill shaft 24 and then extends therefrom along opposite sides longitudinally toward forward end 30 of drill shaft 24. Rearward end 31 of drive shaft 24 is also threaded forward from end face 34, with grooves 33 extending farther toward forward end 30 than does threading 35.

Drill tool piece 22 in a preferred embodiment is made from A53 Butt Weld Pipe and is adapted at its rearward end 37 to be secured within chuck 26 in accordance with the disclosure in U.S. Pat. No. 3,862,750. Of course, other suitable materials may be used for drill tool piece shaft 22 and other known or equivalent thereto means for mating with the drill motor may also be used. Drill tool Piece 22 defines a central longitudinal passageway or bore 38 which is in communication at its rearward end with a source of pressurized air as is known (not shown). The pressurized air source is typically 80 to 110 pounds per square inch. At forward end 39 of drill tool piece 22 is defined a groove 42, similar to groove 33 of drill shaft 24, except that groove 42 extends only radially in end face 43 of forward end 39 and then longitudinally along one side of tool piece 22 toward rearward end 37. Forward end 39 of tool piece 22 is also threaded at 44, with groove 42 extending farther toward the rear than threading 44.

Hollow coupling 23 is made in the preferred embodiment of seamless tubing but of course other suitable materials may be used. Hollow coupling 23 is internally threaded at 46 along its entire length. The total longitudinal length 47 of threading 44 on tool piece 22 and the longitudinal length 48 of threading 35 on drill shaft 24 is greater than the longitudinal length 49 of threading 46 in coupling 23. This is to help Prevent coupling 23 from binding relative to tool piece 22 or drill shaft 24 when the three are secured together or during the drilling operation. In the prior art, the longitudinal distance of threading from end face 43 of tool piece 22 or from end face 34 of drill shaft 24 was such that a coupling, such as coupling 23, could be threadedly secured so far in one direction or another that the internal threading of coupling 23 was advanced onto a non-threaded portion of either tool piece 22 or shaft 24 resulting in severe binding. The length of threading of the present components assures adequate excess threading to prevent such binding.

Because the total drill shaft assembly is made of more than one part, it is possible to make the drill tool piece shaft 22 and drill shaft 24 of various combinations of lengths to achieve the overall length desired.

During the drilling operation, pressurized air is fed through bore 38 of tool piece 22. Within coupling 23, the air flow is directed primarily within groove 33, outward of coupling 23 and along arrows 51 toward forward end 30 of drill shaft 24. Operating under an air pressure of approximately 80 to 110 P.S.I., and due to the restriction in flow area, air flow 51 increases in speed and follows drill shaft 24 into bore 52 in plug 16, agitating and blowing the dust back out. This continues even as drill shaft apparatus 21 including coupling 23 bores deeply into plug 16.

A portion of the pressurized air flowing into coupling 23 also passes through groove 42 and rearwardly of coupling 23 blowing back in the direction of arrows 53. As drill shaft apparatus 22 bores through plug 16 and as coupling 23 passes into bore 52, rearward air flow 53 further aids the removal of the dust within bore 52.

Use of nitrogen instead of air allows pressures of 150 P.S.I. Higher pressure gas flow allows the air flow grooves to be farther back from the drill end 30 and thus longer drill shafts 24 may be used. As is readily apparent, the length of drill shafts, tool piece shafts and location of air flow grooves or holes can be adjusted based upon the particulars of the application.

As with the prior art rock bit 28 and often drill shaft 24 may become damaged from the excessive 2800° F. heat of the molten metal within blast furnace 10. In the present invention, however, drill shaft 24 is much less expensive. The practice of changing the drill shaft and bit with a poking bar to break through the final skull in order to avoid total loss of the bit and drill shaft is now avoided because the drill shaft 24 of the present invention is expendable.

Figure 5:
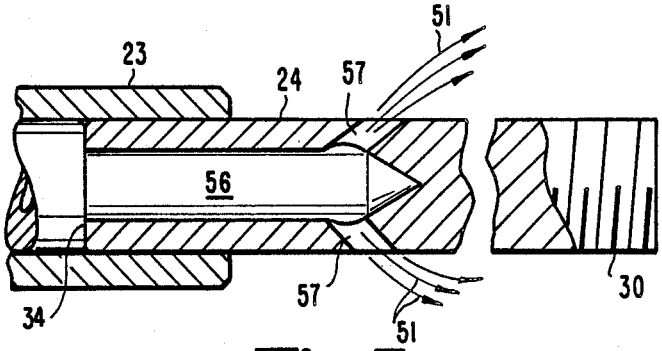
FIG. 5 is a side view, partially in section and partly fragmented, of a drill shaft of an alternative embodiment of the present invention.

An alternative embodiment of the present invention is shown in FIG. 5. In the alternative embodiment of FIG. 5, drill shaft 24 is provided with a central axial bore 56 which extends from end face 34 for a portion of the drill shaft length toward forward end 30. Forward end 30 is still sealed. A pair of opposite and outwardly extending exit bores 57 extend from the forward end of central bore 56 slant forwardly and outwardly from drill shaft 24 to provide forwardly directed exits for high pressure air flow 51. Again a less expensive solid bar can be used instead of the pipe. The bore 56 and exit bores 57 can be readily drilled into the solid bar drill shaft 24. It is to be understood, that the air channel means of the present invention may be placed by appropriate means such as other tubing or holes in solid drill shafts at different locations along the assembly above the drill shaft either along the drill shaft 24 or even the drill tool piece shaft 22. In this manner, dust clearing air flow is available and the problem of molten backwash is minimized. Further, solid shafts can be adapted to be used in the place of the more expensive pipe shafts used in the prior art.

Figure 6:
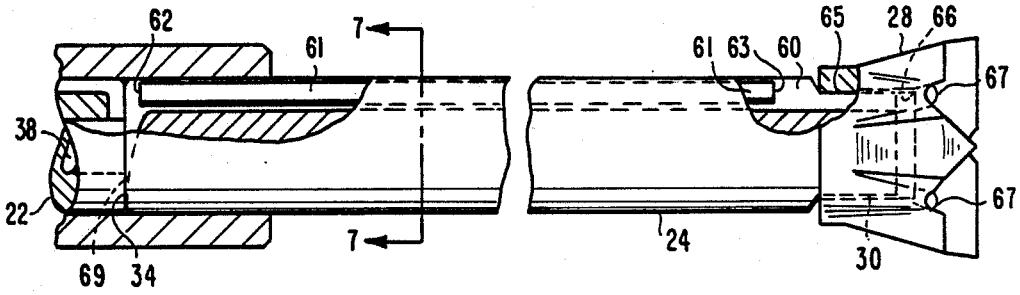
FIG. 6 is a side view, partially in section, of a portion of a drill shaft assembly in accordance with another preferred embodiment of the present invention.
Figure 7:
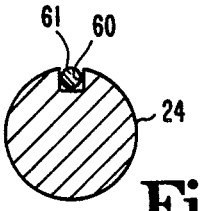
FIG. 7 is a cross-sectional view of the drill shaft of FIG. 6 taken along the lines 7—7 and viewed in the direction of the arrows.

Such an alternative preferred embodiment is shown in FIGS. 6 and 7. There, a solid bar shaft is used for drill shaft 24. An outwardly extending longitudinal groove 60 which extends the entire length from end face 34 to forward end 30 of drill shaft 24 is cut into the solid bar. A metal air blast tube 61 is embedded into groove 60. Tubing 61 is sized to be pressure fit within groove 60 so that no artificial means are necessary to hold tubing 61 therewithin. In the alternative, one or more appropriate, spaced tabs or brackets (not shown) may be affixed (such as by welding) over both groove 60 and tubing 61 to hold tubing 61 firmly therewithin. In this manner the air blast can be provided as desicribed below, backwash is minimized and a lower drill shaft 24 is provided using less expensive materials than the more expensive pipe shaft of the prior art.

Tube 61 is sized so that its rearward end 62 is disposed slightly forward of end face 34 and its forward end 63 is disposed slightly rearward of rock bit 28. Rock bit 28 is held tightly on end 30 of shaft 24 by threaded engagement (65) therebetween. Threaded bore 66 of bit 28 is deeper than the male threaded end 30 of shaft 24. This provides flow communication between the numerous exit holes 67 of bit 28 and groove 60. A groove 69 extends partially diametrically across end face 34 of shaft 24 to provide flow communication between the incoming air flow through central bore 38 of drill tool piece 22 and tubing 61.

In operation, pressurized air forced through bore 38 passes through groove 69, into air blast tubing 61 and exits tubing 61 at forward end 63. Some portion of the pressurized air continues within groove 60 into bit 28 and through exit hole 67 while the remainder of the air passes outside of shaft 24 and bit 28. This configuration creates a circuit of forced air extending all the way down to rock bit 28. Once the final skull is penetrated and molten metal begins to flow upwards along shaft 24, the molten metal will flow more easily along the outside of shaft 24 rather than through the relatively small diameter of air blast tubing 61 thereby reducing the likelihood of molten backwash through the air channels and up to the drill motor.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for boring through the taphole in a molten metal blast furnace, comprising the steps of:

providing a rotary percussion drill adapted for reciprocal rectilinear motion;

providing a drill shaft assembly having:

a drill tool piece shaft having a first end and a second end and a passageway extending through at least a portion of its length, a drill shaft having a first end connected with the second end of said drill tool piece shaft and having means for holding a drill bit, said drill shaft having a solid cross-section along substantially its entire length, a drill bit held by the second end of said drill shaft, air channel means disposed along the length of the drill shaft assembly for directing air flow toward but from a point above the second end of said drill shaft, said air channel means being in flow communication with the passageway of said drill tool piece, and coupler means for connecting the second end of said drill tool shaft to the first end of said drill shaft;

operatively connecting the first end of said drill tool piece shaft with the rotary percussion drill;

applying pressurized air into the passageway at the first end of said drill tool piece shaft so that pressurized air is directed along the drill shaft assembly and toward said drill bit; and, engaging said rotary percussion drill causing said drill bit to bore into the taphole of a molten metal blast furnace.

2. The method for boring through the taphole in a molten metal blast furnace of claim 1 wherein said providing said drill shaft assembly includes said air channel means being a longitudinal groove along the length of said drill shaft and an air blast tube embedded within the groove.

3. The method for boring through the taphole in a molten metal blast furnace of claim 2 wherein the air blast tube has a first end in flow communication with the passageway of said drill tool piece shaft and has a second, opposite end extending substantially all the way to the second end of said drill shaft.

4. A combination comprising:

a molten metal blast furnace having a taphole;

a rotary percussion drill means for boring through said taphole, said drill means being mounted adjacent said taphole;

a drill tool piece shaft having a first end and a second end and a passageway extending through at least a portion of its length;

connecting means for connecting the first end of said drill tool piece shaft with the rotary percussion drill means;

a drill shaft having a first end connected with the second end of said drill tool piece shaft and having a second end having means for holding a drill bit, said drill shaft having a solid cross-section along substantially its entire length;

a drill bit held by the second end of said drill shaft;

air channel means disposed along the length of the drill shaft assembly for directing air flow toward but from a point above the second end of said drill shaft, said air channel means being in flow communication with the passageway of said drill tool piece; and, coupler means for connecting the second end of said drill tool shaft to the first end of said drill shaft.

5. The combination of claim 4 wherein said air channel means includes at least one longitudinal groove defined in the exterior surface of said drill shaft and extending substantially the entire length of said shaft.

6. The combination of claim 5 wherein said air channel means further includes an air blast tube embedded within said longitudinal groove, said tube having a first end in flow communication with the passageway of said drill tool piece shaft and having a second, opposite end extending substantially all the way to the second end of said drill shaft.

7. The combination of claim 4 wherein said drill shaft defines a first face at the first end of said drill shaft, and wherein the air channel means includes a radial air flow groove defined in the first face, the air flow groove being in flow communication with the passageway, and wherein the air flow groove further extends from the first face of said drill shaft along the outside of said drill shaft toward the second end of said drill shaft.

8. The combination of claim 7 wherein said drill shaft has a longitudinal axis and wherein the radial air flow groove extends parallel to the axis from the first face toward the second end of said drill shaft.

9. The combination of claim 7 wherein the radial air flow groove diametrically spans the first face of said drill shaft.

10. The combination of claim 9 wherein said drill shaft has a longitudinal axis and wherein the radial air flow groove extends parallel to the axis from the first face, on opposite sides of said drill shaft and toward the second end of said drill shaft.

11. The combination of claim 7 wherein the passageway is an axial hollow bore which extends to the second end of said drill tool piece shaft.

12. The combination of claim 11 wherein said drill tool piece shaft defines a second face at the second end of said tool piece drill shaft, wherein the air channel means further includes a back air flow groove defined in the second face, the back air flow groove extending radially from and being in flow communication with the hollow bore, and wherein the back air flow groove further extends from the second face exteriorly of said drill tool piece shaft toward the first end of said drill tool piece shaft.

13. The combination of claim 12 wherein said drill tool piece shaft has a longitudinal axis and wherein the back air flow groove extends parallel to the axis of said drill tool piece shaft.

14. The combination of claim 4 wherein said drill shaft is externally threaded a first longitudinal length at the first end of said drill shaft, and wherein said drill tool piece shaft is externally threaded a second longitudinal length at the second end of said drill tool piece shaft, and wherein said coupler means is a hollow coupling having internal threading for meshing with and drawing together said drill shaft and said drill tool piece shaft.

15. The combination of claim 14 wherein the internal threading of said hollow coupling has a third longitudinal length which is less than the sum of the first and second longitudinal lengths.

16. The combination of claim 4 wherein said drill shaft defines a first face at the first end of said drill shaft, and wherein said air channel means includes:

a central longitudinal bore extending from the first face and partway toward the second end of said drill shaft, the central bore being in flow communication with the passageway of said drill tool piece, and at least one exit bore radially extending from and being in communication with said central bore.

17. A combination comprising:

a molten metal blast furnace having a taphole;

a molten metal blast furnace drilling means for drilling through the taphole of said molten metal blast furnace;

said drilling means including a drilling shaft means for holding a drill bit and for imparting rotational motion from said drilling means to said drill bit;

said drilling shaft means including a drill tool piece shaft having a first end rotatably mounted to said drilling means, a second opposite end, and a central bore;

said drilling shaft means further including a coupler means having first mounting side and a second opposite mounting side, said first mounting side being connected to said second end of said drill tool piece shaft;

said drilling shaft means further including a drill shaft being substantially a solid bar, said drill shaft having a first end connected to said second mounting side of said coupler and said drill shaft having air channel grooves cut into the exterior surface of said solid bar;

said drill bit being connected to the second end of said drill shaft;

pressurized air means in flow communication with the first end of said axial bore of said drill tool piece shaft for providing pressurized air flowing through said bore and then through said coupler and then along said grooves in said drill shaft.

18. The combination of claim 17 wherein said drill shaft includes at least one longitudinal groove defined in the exterior surface of said drill shaft and extending substantially the entire length of said shaft.

19. The combination of claim 18 including an air blast tube embedded within said longitudinal groove, said tube having a first end in flow communication with the bore of said drill tool piece shaft and having a second, opposite end extending substantially all the way to the second end of said drill shaft.

* * * * *